US006881143B2

(12) United States Patent
Richardson

(10) Patent No.: US 6,881,143 B2
(45) Date of Patent: Apr. 19, 2005

(54) CONSERVATORY ROOF VENTILATION

(75) Inventor: Christopher Richardson, Clitheroe (GB)

(73) Assignee: Ultraframe (UK) Limited, Lancashire (GB)

( * ) Notice: Subject to any disclaimer, the term of this patent is extended or adjusted under 35 U.S.C. 154(b) by 257 days.

(21) Appl. No.: 10/093,647

(22) Filed: Mar. 8, 2002

(65) Prior Publication Data

US 2002/0160707 A1 Oct. 31, 2002

(30) Foreign Application Priority Data

Mar. 9, 2001 (GB) ..... 0105890

(51) Int. Cl.[7] ..... F24F 7/00
(52) U.S. Cl. ..... 454/358; 454/213; 52/200
(58) Field of Search ..... 454/358, 213, 454/199, 363; 52/200

(56) References Cited

U.S. PATENT DOCUMENTS 2,201,175 A * 5/1940 Harshberger ..... 52/539
4,438,680 A * 3/1984 Esposito ..... 454/341
4,614,067 A * 9/1986 Matsubara ..... 52/235
4,616,560 A 10/1986 Esposito
5,927,027 A * 7/1999 Richardson ..... 52/200
6,026,615 A 2/2000 Richardson
6,161,346 A * 12/2000 Richardson ..... 52/198

FOREIGN PATENT DOCUMENTS

| | | | |
|---|---|---|---|
| DE | 44 08 374 | A | 9/1995 |
| EP | 115824 | A | 8/1984 |
| EP | 368397 | A | 5/1990 |
| EP | 918131 | A | 5/1999 |
| EP | 1050659 | A | 11/2000 |
| GB | 2194328 | A | 3/1988 |
| GB | 2239309 | A | 6/1991 |
| GB | 2286454 | A | 8/1995 |

* cited by examiner

*Primary Examiner*—Derek S. Boles
(74) *Attorney, Agent, or Firm*—Wood, Phillips, Katz, Clark & Mortimer

(57) ABSTRACT

A trickle ventilator for a conservatory roof to be sited between an eaves beam of the roof and a glazing panel extending over the eaves beam, the ventilator comprising an elongate body having a front and rear walls spaced apart, at least one aperture in each wall and a gate for selectively closing the or each aperture in the front wall to control airflow into or out of the conservatory.

16 Claims, 5 Drawing Sheets

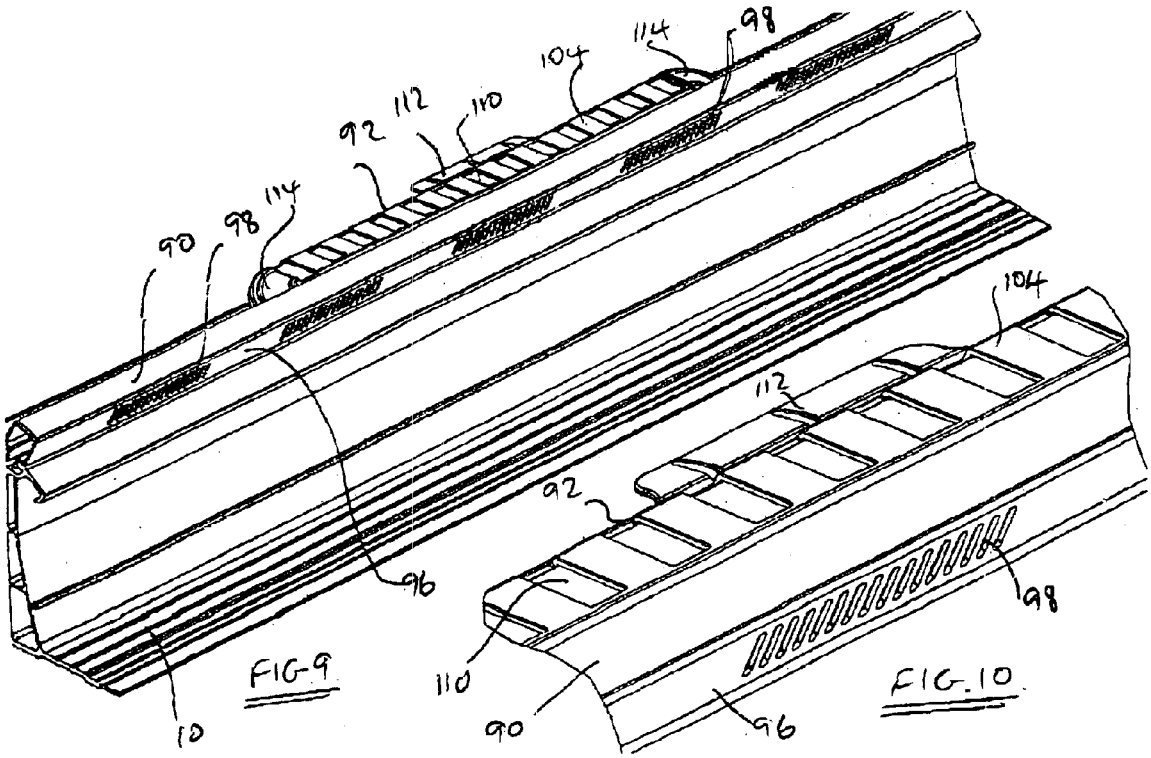
FIG-9
FIG-10
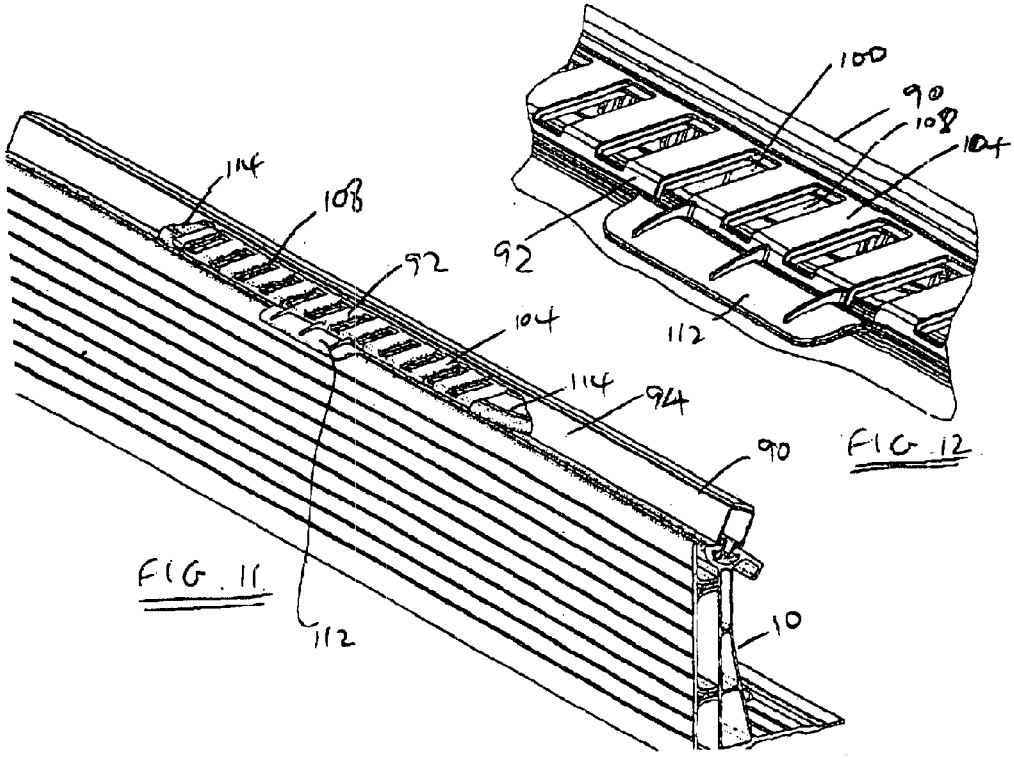
FIG-11
FIG-12

CONSERVATORY ROOF VENTILATION

This invention concerns conservatory roof ventilation and, in particular, concerns a ventilation component for use in conservatory roofs.

A typical conservatory roof construction comprises an eaves beam and a ridge beam with glazing bars supported on them at each end. The glazing bars support between them glazing panels. At the eaves beam the glazing panels are raised above the eaves beam by the glazing bars leaving gaps between the eaves beam and the glazing panels. These gaps are usually filled by sealing strips that locate in the top of the eaves beam and have on their top surface a foam strip or the like to seal against the underside of the glazing panels. These sealing strips provide draught exclusion but, in order to provide for trickle ventilation, the sealing strips have been modified to incorporate hit and miss ventilation. This has been achieved by forming apertures in one side of the sealing strip and providing a slidable apertured plate within the sealing strip for closing or exposing the apertures in the sealing strip. The production of sealing strips with integral hit and miss ventilation is labour intensive and hence expensive relative to the importance of the item.

An object of this invention is to provide an improved ventilation means for providing trickle ventilation for a conservatory roof.

Accordingly, the present invention provides a trickle ventilator for a conservatory roof to be sited between an eaves beam of the roof and a glazing panel extending over the eaves beam, the ventilator comprising an elongate body having front and rear walls spaced apart, at least one aperture in each wall and a gate for selectively closing the or each aperture in the front wall to control airflow into or out of the conservatory.

The gate of the ventilator may comprise a flap or a hit and miss assembly for selectively allowing or preventing airflow into or out of the conservatory.

A preferred elongate member of the ventilator has a top and a base that is preferably open.

In practice the front wall of the ventilator of the invention will usually be internal to the conservatory and the rear wall external to the conservatory. The rear ventilation apertures are preferably provided by one or more grill sections preferably providing vertical slits. The slits are preferably of a width sufficiently narrow to inhibit passage of insets through the ventilator. The slits are preferably of no more than 3 mm in width.

The front ventilation aperture or apertures may be drilled, cut or punched into the front wall of the elongate member, over which the gate operates. In a preferred embodiment, the front ventilation aperture is a slot.

The elongate member of the invention preferably has means for location on the eaves beam of a conservatory roof. A preferred eaves beam is slotted along its length and the elongate member has formations thereon for locating in said slot. Preferably the eaves beam slot has a relatively narrow opening and the formations of the elongate member are shaped and sized to snap fit into the eaves beam slot. Preferably, such formations are at least at ends of the ventilator and possibly at spaced intervals on the underside of the elongate member. Such formations preferably take the form of resiliently deformable tabs that can snap-fit into the slot in the top of the eaves beam. Preferably the tabs are slotted top receive the edges of the eaves beam slot.

It is envisaged that the elongate members of the invention will be used in combination with the above-mentioned sealing strips and cut to length to produce the overall required length of seal for any particular glazing panel. Preferably, ends of the elongate members will be provided with mating formations for connecting same to conventional sealing strips or even to further ventilators.

The elongate members and/or sealing strips for use therewith may be provided on at least one longitudinal surface thereof, typically a top surface, with generally evenly spaced transverse grooves as guides for cutting down an elongate member or sealing strip to a size to provide for a required length of sealing. Internally, there may be webs linking the top and base of the elongate member corresponding with the grooves, whereby removal of part of a member at one of said grooves does not affect its integrity.

The gate component of the ventilator may comprise a hinged flap, which has its bottom edge located in a groove of the front edge of the base of the elongate member.

The hinged flap of the gate preferably has a lever for opening and closing thereof. The lever preferably has a depending handle that can be used to operate the lever. The lever is preferably colour coded, so that it can be determined from below whether the ventilator is open or closed. Thus, one side of the lever bears a colour to indicate that the flap is open and the opposite side bears a colour to indicate that the flap is closed.

The ventilation flap preferably has means for step-wise opening of the flap, such as at least one notched projection that engages an edge or lip of the ventilator body and preferably of the top of the ventilator. There are preferably two such projections, one at each end of the flap and these are preferably generally segmental with an arcuate notched top edge.

In an alternative preferred embodiment of the invention the elongate member comprises a sealing strip for between an eaves beam and a glazing panel supported over the eaves beam and having apertures in an outer face thereof and a hit and miss gate assembly over an aperture in an inner face thereof. The gate component preferably comprises an open-backed body for affixing over the front ventilation aperture of the elongate member. In a preferred embodiment, one or more apertures are provided in the gate body to allow air to pass from the exterior of the conservatory, through the elongate member and the gate body to the interior of the conservatory, and vice-versa.

There may also be provided within the body of the gate component, an apertured plate slidable relative to the apertures of the body to provide a hit and miss arrangement. Thus, when the apertures of the plate and body coincide, the ventilator is open, and when the apertures of the plate and body do not coincide, the gate is closed.

Preferably also, there is provided a handle for moving the sliding plate between open and closed positions. The handle or sliding plate is preferably colour code, so that it can be determined from below whether the ventilator is open or closed. Thus, certain parts of the plate may bear coloured portions that coincide with the apertures in the body of the gate when in the closed position say, to indicate that the ventilator is closed.

Ventilator components according to the invention are preferably formed by injection moulding or by extrusion of plastics material.

This invention will now be further described by way of example only, with reference to the accompanying drawings, in which:

FIG. 9 shows a fourth embodiment of a ventilator of the invention mounted on an eaves beam, having a hit and miss gate and closed;

FIG. 10 shows detail of the ventilator of FIG. 9;

FIG. 11 shows the ventilator of FIG. 9 open;

FIG. 12 shows detail of the ventilator of FIG. 11;

Figures 1, 2, 3:
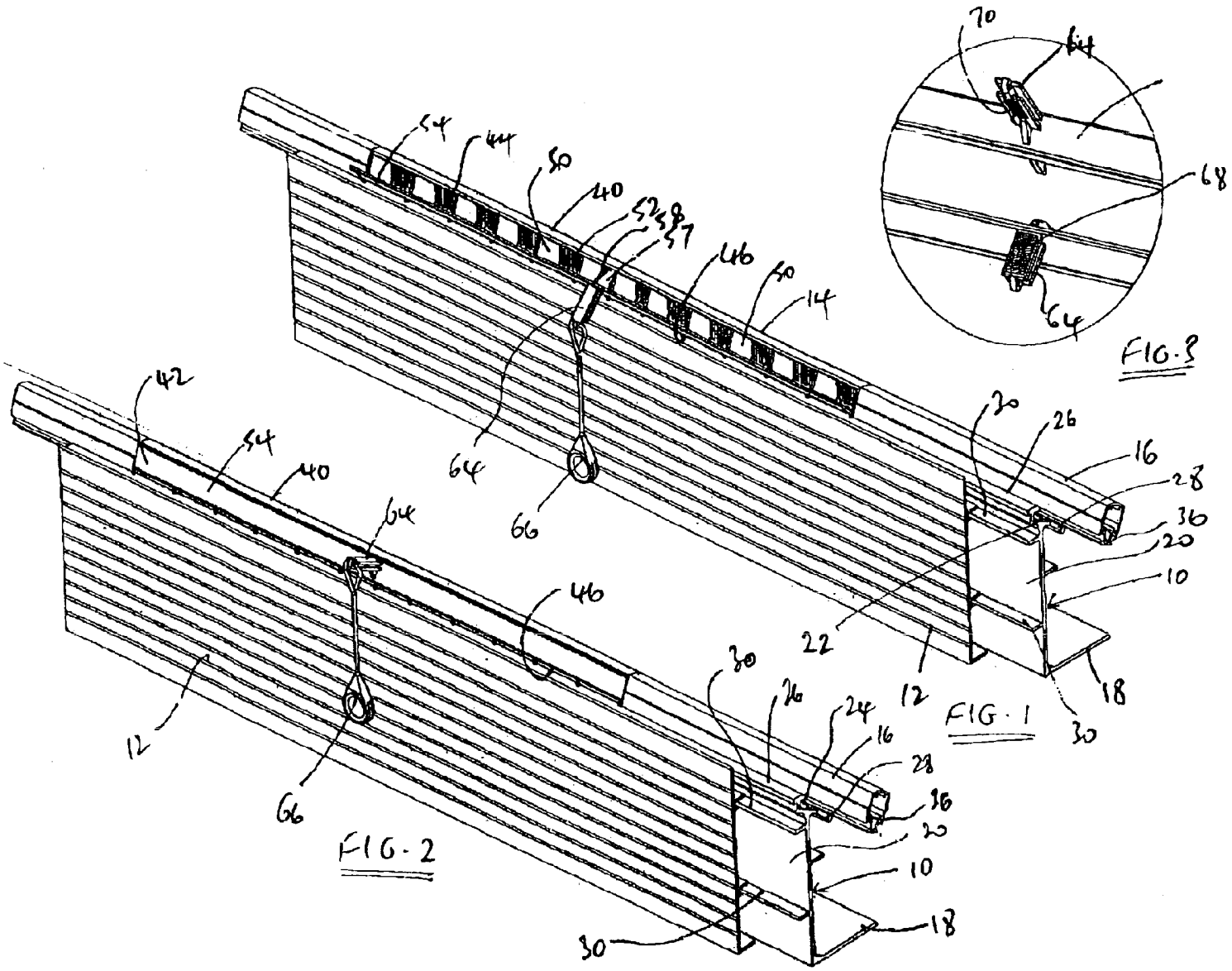
FIG. 1 shows a first embodiment of a ventilator of the invention mounted on an eaves beam and open.
FIG. 2 shows the ventilator of FIG. 1 closed.
FIG. 3 shows detail of the ventilator of FIGS. 1 and 2.

Referring to FIGS. 1 to 3 of the accompanying drawings, an eaves arrangement for a conservatory roof is shown, in which an eaves beam 10 has internal cladding 12 of PVCu fixed to one face thereof and seating means mounted on top of the saves beam comprising a ventilator 14 and conventional sealing strips 16. The eaves beam 10 is extruded from aluminium and is generally of L-section having a base 18 adapted for mounting on top of window frames forming the conservatory walls and an upstanding side 20.

On top of the upstanding side 20 of the eaves beam is a head 22 having an inverted generally T-section channel 24 formed therein. The head 22 has a top surface 26 extending onto flange 28, the top surface 28 being generally arcuate. The head 22 of the eaves beam supports glazing bars between which are held glazing panels and the T-section channel 24 is to retain heads of bolts used to secure the glazing bars to the eaves beam. On the intended inner face of the upstanding side 20 of the eaves beam are barbed flanges 30 onto which the internal cladding 12 is a push-fit.

The T-section channel 24 of the head of the eaves beam 10 also serves as a location for reaching retaining formations 32,34 (see later) of the ventilator and 36 of the adjacent sealing strips. The sealing strips 16 are generally inverted U-section elongate members with depending formations 36 for engagement in the T-section channel of the eaves beam. The top surface of the sealing strips usually carries a layer of foam rubber or the like to improve the seal with the overlying glazing panels.

The ventilator 12 is made by injection moulding of plastics material and has ia generally hollow elongate body comprising a top 40, front 42 back 44, base 46 and ends 48. The top 40 is closed, whereas the base 46 is open. The top and base are connected by the ends 48 and by intermediate webs 50 at spaced intervals. The back 44 of the ventilator is in the form of a grill providing apertures 52 in the form of vertical slits. The slits have a width of 3 mm, which is generally sufficiently narrow to prevent or deter passage of insects through the ventilator.

The front 42 of the ventilator is open but closable by means of a hinged flap 54. The flap 54 has its bottom edge located in groove 56 along the front edge of the base 46, so that it can pivot between open and closed positions (see FIGS. 1 and 2 respectively). The flap 54 has a segmental projection 57 from its rear face that has a notched top edge 58. The notches 60 of the projection 57 engage in a stepwise manner with the front de 62 of the top 40 of the ventilator, which forms a lip for that purpose. Thus, the flap can be opened to different extents, as desired to increase or reduce ventilating airflow through a conservatory.

Projecting from the front of the flap 54 is a lever 64 for use in opening and closing the flap. The lever 64 has a depending handle 66 to facilitate operation of the lever. The lever has top and bottom surfaces 68,70 respectively each arm colour coded differently, so that a person viewing the lever from below can ascertain whether the flap is open or closed (see FIG. 3 of the drawings).

Figures 4, 5, 6:
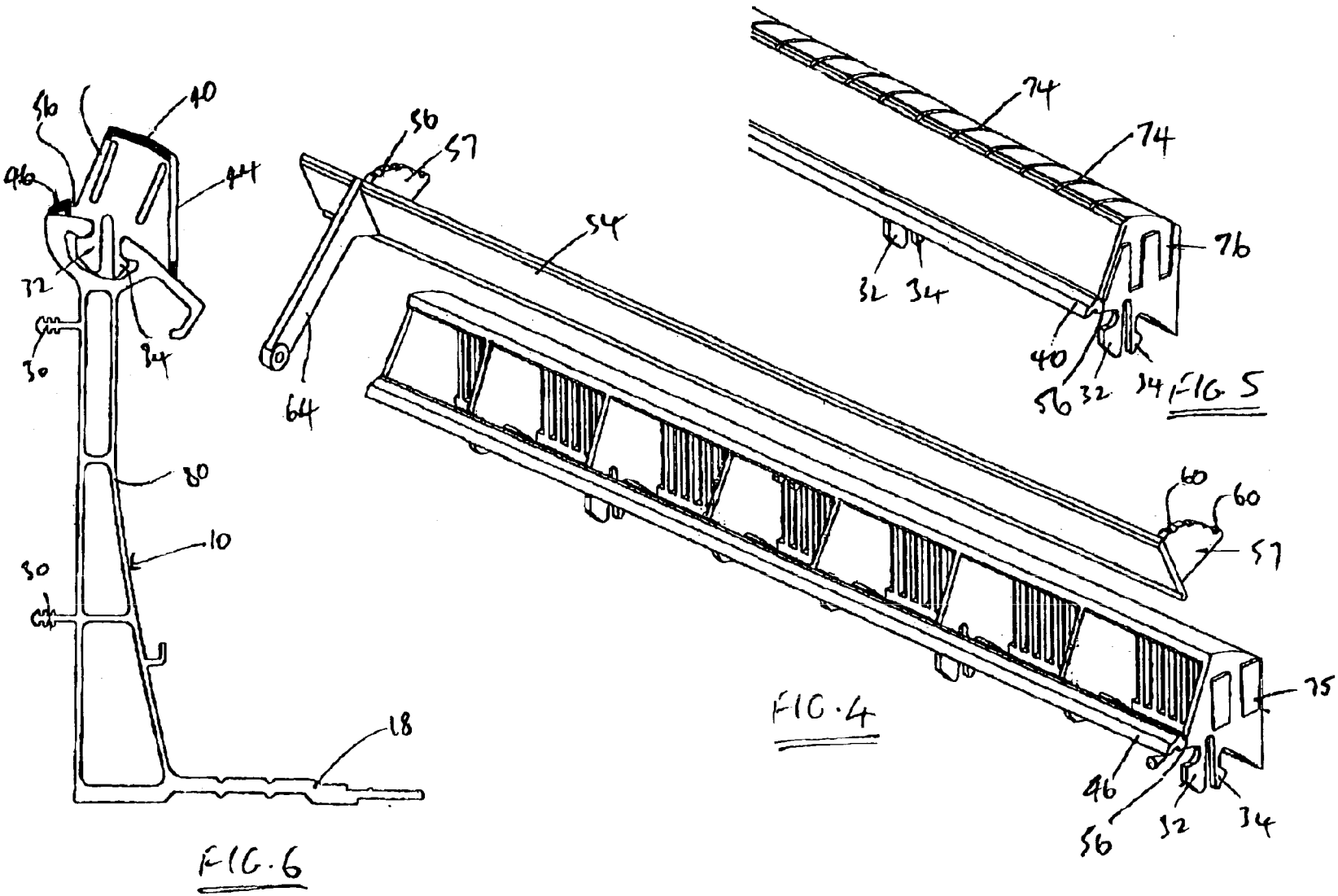
FIG. 4 shows a second embodiment of a ventilator of the invention.
FIG. 5 shows a variation on the embodiment of FIG. 4.
FIG. 6 shows a ventilator of FIG. 4 mounted on an eaves beam.

Modifications to and further features of ventilators of FIGS. 1 to 3 are shown in FIGS. 4 to 6 of the accompanying drawings. Like parts in all of the drawings have been given the same reference numbers for simplicity. Firstly, the formations 32,34 for retaining the ventilator on an eaves beam are shown. These formations are resiliently deformable tabs depending from the ends 48 of the ventilator and from the intermediate webs 50. The tabs 32,34 are notched (72), so that edges of the eaves beam T-section channel 24 snap into said notches 72, when the ventilator is pushed down onto the head of the eaves beam (see FIG. 6 of the drawings).

Secondly, along the top surface 40 of the ventilator are spaced grooves 74 corresponding to the intermediate webs 50. These grooves 74 indicate positions at which a portion of a ventilator can be removed to form a ventilator of lesser length without affecting its integrity.

Thirdly, ends 48 of the ventilator have tongue and groove formations 75,76 thereon, whereby ventilators can be linked together to form a longer ventilator, if required.

Fourthly, instead of a single notched projection 57, there are two, one near each end of the flap.

It is also to be noted that the form of the eaves beam shown with the ventilator of FIGS. 4 to 6 is slightly different to that shown in FIGS. 1 and 2, in that te eaves beams has a twin walled upstand 80.

Figure 8:
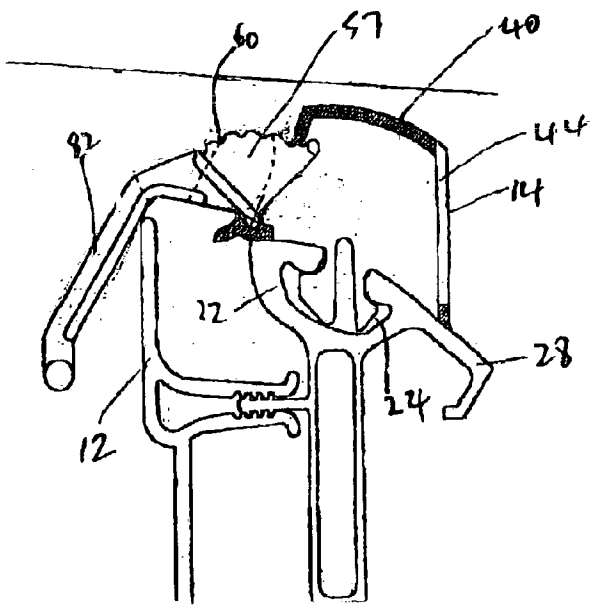
FIG. 8 shows the ventilator of FIG. 7 open.
Figure 7:
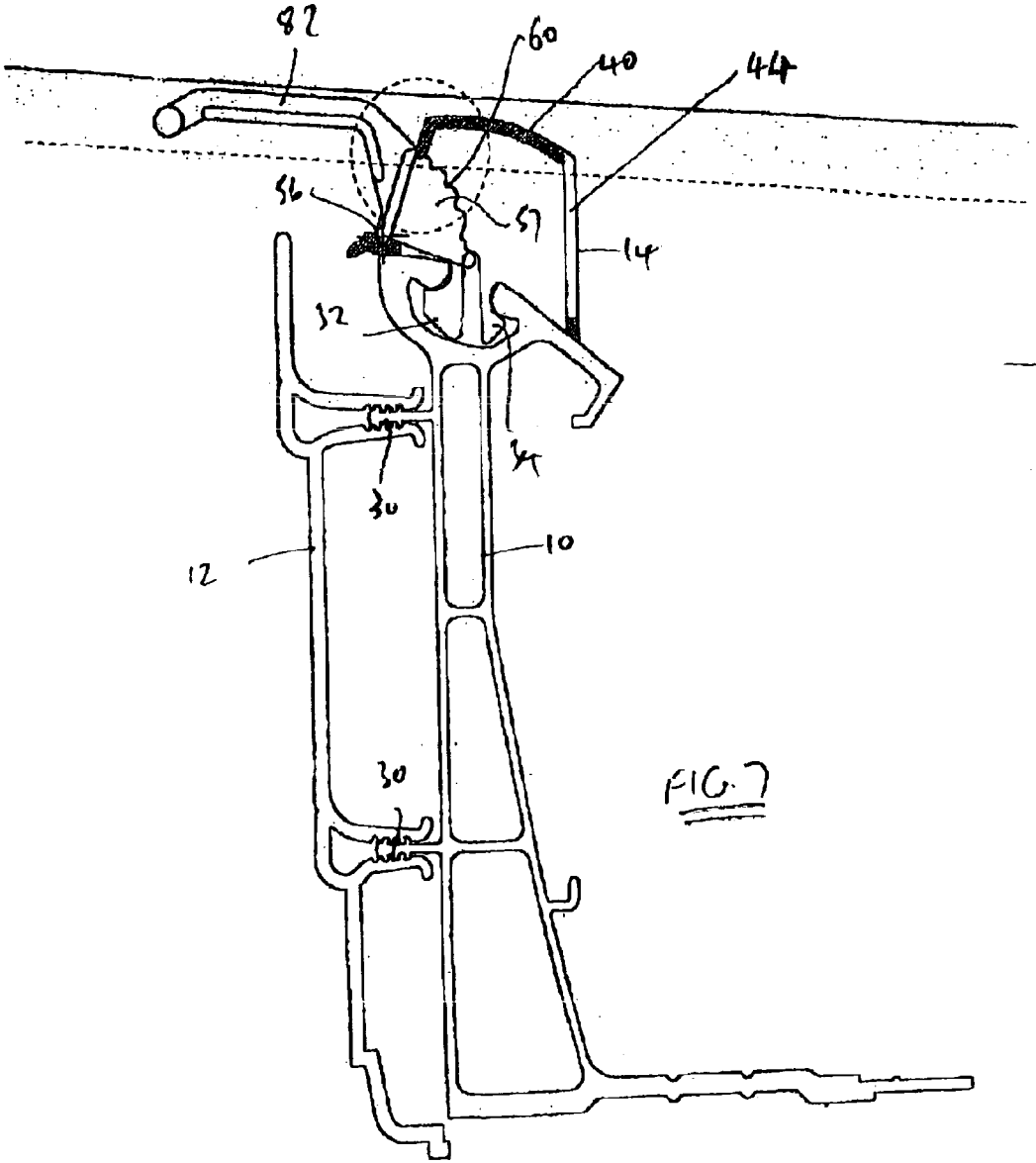
FIG. 7 shows a third embodiment of a ventilator of the invention mounted on an eaves beam and closed.
Figure 14:
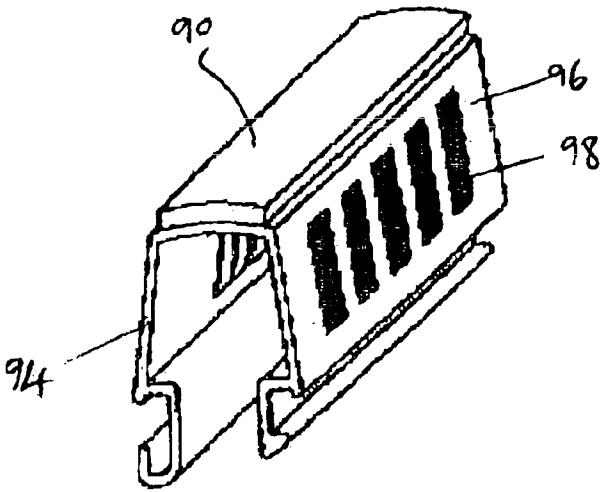
FIG. 14 shows a short length of the elongate member of the ventilator.
Figure 13:
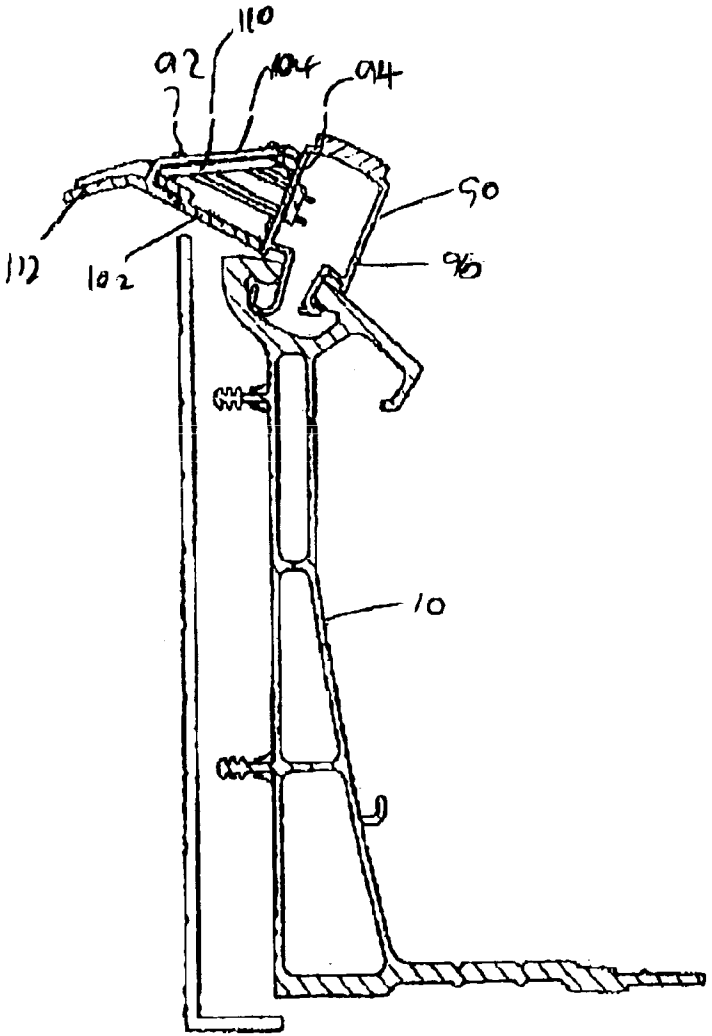
FIG. 13 shows a section of FIGS. 9 and 11 on X—X.

Furthermore, in FIGS. 7 and 8, there is shown a further variation to the previously de ventilators, wherein operating lever 82 is angled to increase the range of lap opening without the lever hitting the top edge of the internal eaves beam cladding 12.

Turning now to FIGS. 9 to 14 of the accompanying drawings, a fourth embodiment of the invention is shown comprising a sealing strip 90 of the same general type as sealing strip 16 of the embodiment of FIG. 1 of the of drawings and a gate assembly 92 attached thereto. The sealing strip 90 has an inner lace 94 and an outer face 95. The outer face 96 has a series of slits 98 formed therein. The inner face 94 has a longitudinal slot 100 therein and the gate assembly 92 is fixed over the slot 100.

The gate assembly has a base 102 and a top 104 angled upwardly from one edge of the base leaving an open back to the gate assembly that overlies the slot 100. The top 104 has a series of ventilation openings 108 therein and a correspondingly apertured plate 110 is slidably mounted on the underside of the top 104 of the gate assembly. The apertured plate 110 has a handle 112 whereby it can be slid along either to bring its apertures into line fully or partially with the openings in the top 104 for ventilation or to close the openings.

In use, the elongate member 90 is cut to the desired length, the span of a glazing panel say, the longitudinal slot 100 is then formed in the inner face 94 of the elongate member 90 at a desired position, and the gate assembly 92 is fixed thereover. Fairing components 114 may also be added at each end of the gate assembly for improving the appearance of the ventilator. Ribs are provided on the top face of 104 and on the fairings 114, in order to prevent closing of the ventilator at very low roof pitches, when the ventilator has been defected due to expansion of the roofing panels.

What is claimed is:

1. For a conservatory roof, a trickle ventilator to be sited between an eaves beam of the roof and a glazing panel extending over the eaves beam, the ventilator comprising an elongate body having front and rear walls spaced apart, at least one aperture in each wall, and a gate for selectively closing the or each aperture in the front wall to control airflow into or out of the conservatory, wherein the ventilator has, on at least one longitudinal surface thereof, generally evenly spaced grooves as guides for cutting down an elongate member to a size to provide for a required length of sealing, wherein the elongate member has a top and a base, and wherein there are webs linking the top and the base of the elongate member corresponding to the grooves.

2. For a conservatory roof, a trickle ventilator to be sited between an eaves beam of the roof and a glazing panel extending over the eaves beam, the ventilator comprising an elongate body having front and rear walls spaced apart, at least one aperture in each wall, and a gate for selectively closing the or each aperture in the front wall to control airflow into or out of the conservatory, wherein the ventilator has, on at least one longitudinal into or out of the thereof, generally evenly spaced grooves as guides for cutting down an elongate member to a size to provide for a required length of sealing, wherein the elongate member has a top and a base, wherein the gate of the ventilator comprises a hinged flap, which has its bottom edge located in a groove of the front edge of the base of the elongate member, wherein the hinged flap has a lever for opening and closing thereof, and wherein the lever is colour coded, so that it can be determined from below whether the ventilator is opened or closed.

3. A trickle ventilator according to claim 2, wherein the lever has a depending handle that can be used to operate the lever.

4. For a conservatory roof, a trickle ventilator to be sited between an eaves beam of the roof and a glazing panel extending over the eaves beam, the ventilator comprising an elongate body having front and rear walls spaced apart, at least one aperture in each wall, and a gate for selectively closing the or each aperture in the front wall to control airflow into or out of the conservatory, wherein the ventilator has, on at least one longitudinal surface thereof, generally evenly spaced grooves as guides for cutting down an elongate member to a size to provide for a required length of sealing, wherein the elongate member has a top and a base, wherein the gate of the ventilator comprises a hinged flap, which has its bottom edge located in a groove of the front edge of the base of the elongate member, and wherein the hinged flap has means for step-wise opening thereof.

5. A trickle ventilator according to claim 4, wherein said means for step-wise opening comprises at least one notched projection that engages an edge or lip of the ventilator body.

6. A trickle ventilator according to claim 5, wherein the at least one notched projection also engages the top of the ventilator.

7. A trickle ventilator according to claim 5, wherein there are two said projections, one at each end of the flap.

8. A trickle ventilator according to claim 7, wherein the projections are generally segmented with an arcuate notched top edge.

9. For a conservatory roof, a trickle ventilator to be sited between an eaves beam of the roof and a glazing panel extending over the eaves beam, the ventilator comprising an elongate body having front and rear walls spaced apart, at least one aperture in each wall, and a gate for selectively closing the or each aperture in the front wall to control airflow into or out of the conservatory, wherein the elongate member comprises a sealing strip for sealing between an eaves beam and a glazing panel supported over the eaves beam, the sealing strip having apertures in an outer face thereof, and wherein a hit and miss assembly is located over an aperture in an inner face thereof.

10. A trickle ventilator according to claim 9, wherein the gate assembly comprises an open-backed body affixed over a front ventilation aperture of the elongate member.

11. A trickle ventilator according to claim 10, wherein one or more apertures are provided in the gate body and within the gate body there is an apertured plate slidable relative to the aperture or apertures of the gate body to provide a hit and miss arrangement.

12. A trickle ventilator according to claim 11 having a handle for moving the slidable plate between open and closed positions.

13. A trickle ventilator according to claim 12, wherein the handle or slidable plate is colour coded.

14. A trickle ventilator according to claim 9, wherein the gate assembly has a top surface provided with one or more ribs.

15. A trickle ventilator according to claim 14, wherein the gate assembly has fairings at opposite ends thereof.

16. A trickle ventilator according to claim 14, wherein the fairings have ribs on their top faces.

* * * * *